US012181208B2

(12) United States Patent
Krieger et al.

(10) Patent No.: US 12,181,208 B2
(45) Date of Patent: Dec. 31, 2024

(54) REFRIGERATOR APPLIANCE SUBCOMPONENT MOUNTING SYSTEM

(71) Applicant: WHIRLPOOL CORPORATION, Benton Harbor, MI (US)

(72) Inventors: Tomaz Ferreira Krieger, Joinville (BR); Marco Aurélio Dellabruna Maccarini, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 288 days.

(21) Appl. No.: 17/747,623

(22) Filed: May 18, 2022

(65) Prior Publication Data

US 2023/0375254 A1 Nov. 23, 2023

(51) Int. Cl.
*F25D 23/06* (2006.01)

(52) U.S. Cl.
CPC ..... *F25D 23/066* (2013.01); *F25D 23/067* (2013.01); *F25D 2201/14* (2013.01)

(58) Field of Classification Search
CPC ..... F25D 23/066; F25D 23/067; F25D 25/02
See application file for complete search history.

(56) References Cited

U.S. PATENT DOCUMENTS

| | | | | |
|---|---|---|---|---|
| 3,300,169 | A | 1/1967 | Fisher | |
| 4,456,211 | A * | 6/1984 | Wyckoff | A47B 57/42 248/309.2 |
| 4,752,171 | A * | 6/1988 | Pliml, Jr. | B29C 65/069 411/181 |
| 10,215,474 | B2 * | 2/2019 | Lim | F25D 25/025 |
| 2004/0263038 | A1 * | 12/2004 | Ribolzi | F25D 23/067 312/408 |
| 2006/0232177 | A1 * | 10/2006 | Filho | F16B 12/26 312/407 |
| 2007/0210089 | A1 * | 9/2007 | Kauk | B29C 44/16 220/592.1 |
| 2007/0228236 | A1 | 10/2007 | MacKay et al. | |
| 2021/0215415 | A1 | 7/2021 | Potter et al. | |

FOREIGN PATENT DOCUMENTS

FR 2587770 A1 * 3/1987

* cited by examiner

*Primary Examiner* — David J Teitelbaum
(74) *Attorney, Agent, or Firm* — Brooks Kushman P.C.

(57) ABSTRACT

A refrigerator appliance includes a cabinet, an anchor, a subcomponent, and a fastener. The cabinet has walls that define an internal storage chamber. A first of the walls defines a pocket that extends outward from and is open to the internal storage chamber. The anchor is disposed within the pocket and engages the first of the walls such that the anchor is secured to the first of the walls. The subcomponent is disposed within the internal storage chamber. The fastener secures the subcomponent to the anchor.

11 Claims, 4 Drawing Sheets

REFRIGERATOR APPLIANCE SUBCOMPONENT MOUNTING SYSTEM

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes a cabinet, an inner liner, an insulating material, a fastening anchor, a subcomponent, and a fastener. The cabinet has walls that define an internal cavity. The inner liner is disposed within the internal cavity such that a gap is defined between the walls and the inner liner. The inner liner defines a storage chamber on an opposing side of inner liner relative to the gap. The inner liner has a protrusion extending into the gap. The protrusion defines a pocket on an opposing side of the gap. The pocket is open to the storage chamber. The pocket is segregated from the gap. The insulating material is disposed within the gap, between the walls and the inner liner, and over the protrusion. The fastening anchor is disposed within the pocket. The fastening anchor engages the inner liner within the pocket such that the fastening anchor is secured to the inner liner. The subcomponent is disposed within the storage chamber. The fastener engages the subcomponent and the fastening anchor to secure the subcomponent to the inner liner and to the fastening anchor.

A refrigerator appliance includes cabinet walls, a liner, an anchor, a subcomponent, and a fastener. The cabinet walls define an internal cavity. The liner is disposed within the internal cavity. The liner defines an internal storage chamber. The liner defines a pocket. The pocket extends toward one of walls and is open to the internal storage chamber. The anchor is disposed within the pocket. The anchor engages the liner such that the anchor is secured to the liner. The subcomponent is disposed within the internal storage chamber. The fastener engages the subcomponent and the anchor to secure the subcomponent to the anchor.

A refrigerator appliance includes a cabinet, an anchor, a subcomponent, and a fastener. The cabinet has walls that define an internal storage chamber. A first of the walls defines a pocket that extends outward from and is open to the internal storage chamber. The anchor is disposed within the pocket and engages the first of the walls such that the anchor is secured to the first of the walls. The subcomponent is disposed within the internal storage chamber. The fastener secures the subcomponent to the anchor.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
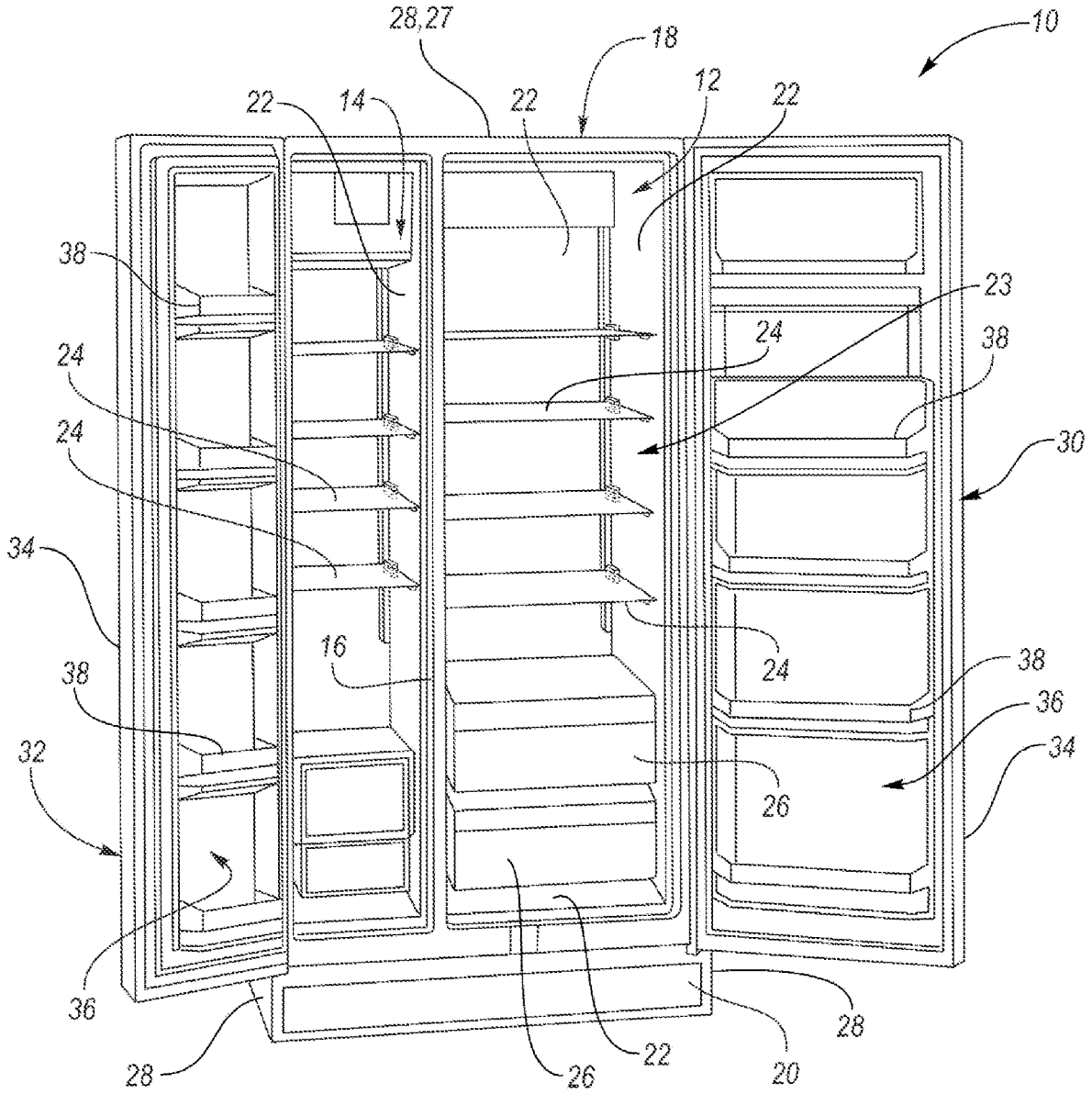
FIG. 1 is a front perspective front view of a side-by-side type refrigerator.
Figure 2:
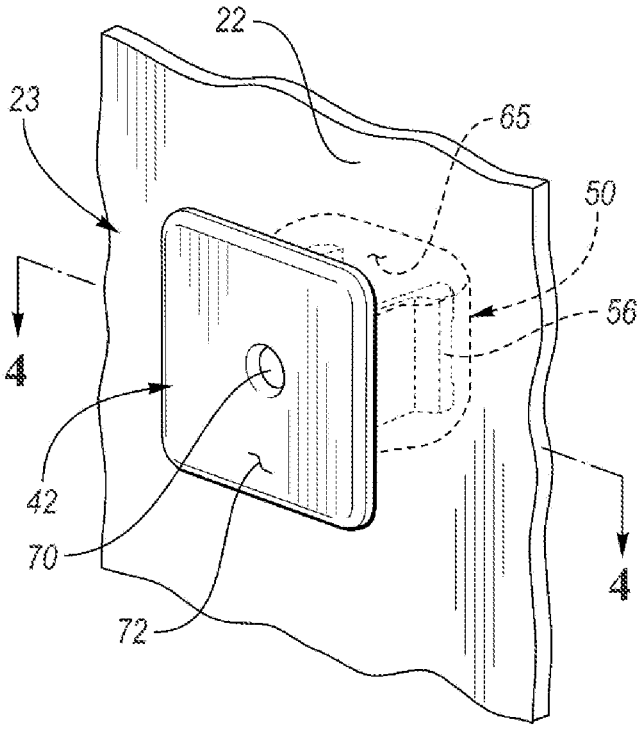
FIG. 2 is a front isometric view of a fastening anchor that is secured to an inner liner of the refrigerator.
Figure 3:
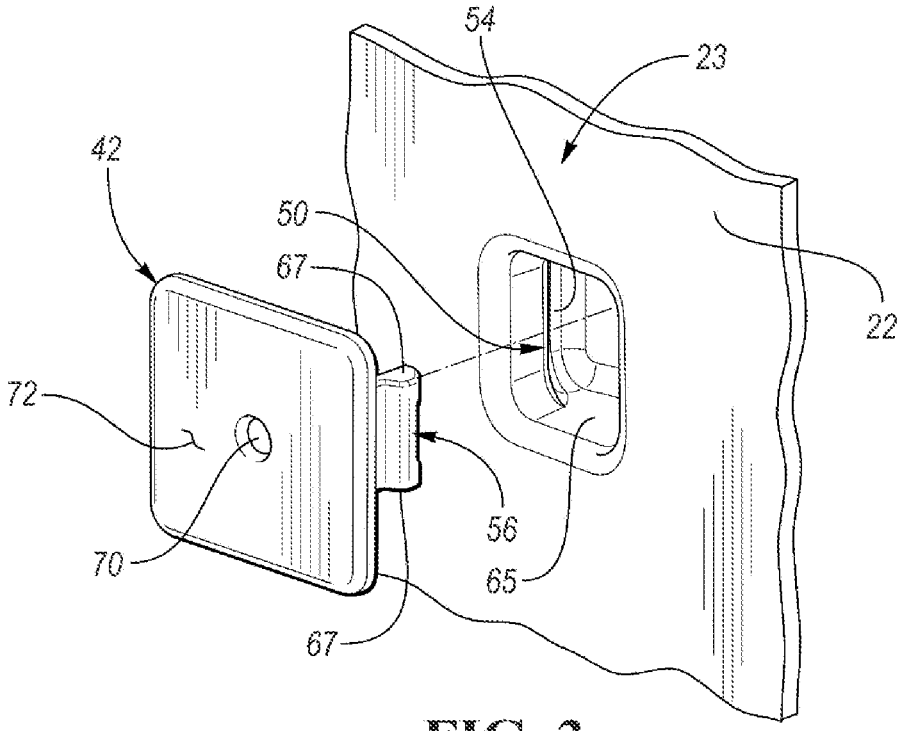
FIG. 3 is a front isometric exploded view of the fastening anchor that is secured to the inner liner of the refrigerator.

Referring to FIG. 1, generally a refrigerator 10 of the side-by-side type is illustrated. However, it should be understood that this disclosure could apply to any type of refrigerator, such as a side-by-side, French-Door Bottom Mount, or a top-mount type. As shown in FIG. 1, the refrigerator 10 may have a first internal cavity, first internal storage chamber, or fresh food compartment 12 configured to refrigerate and not freeze consumables within the fresh food compartment 12, and a second internal cavity, second internal storage chamber, or a freezer compartment 14 configured to freeze consumables within the freezer compartment 14 during normal use. The refrigeration compartment 12 and the freezer compartment 14 are separated by a dividing wall 16. The fresh food compartment 12 and freezer compartment 14 may be defined by a housing or cabinet 18 of the refrigerator 10. It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The interior of refrigerator 10, including the refrigeration compartment 12 and the freezer compartment 14, is cooled by one or more evaporators (not shown) that are part of one or more refrigerant loops or circuits. The evaporator may be located in the freezer compartment if only one evaporator is included. Each refrigerant circuit may also include a compressor (not shown) and a condenser (not shown), which may be located in a machine or machinery compartment 20. The condenser is configured to reject heat from the refrigerant circuit to the ambient surroundings. Fans may be utilized to direct air across the evaporator and the condenser to facilitate exchanging heat. The compressor and the fans may be connected to a controller. Sensors that measure the air temperature, humidity, etc. within the refrigeration compartment 12 and the freezer compartment 14 may be in communication with the controller. The controller may be configured to operate the compressor, fans, etc. in response to the air temperature within the refrigeration compartment 12 and the freezer compartment 14 being less than a threshold.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

Control logic or functions performed by the controller may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description.

The control logic may be implemented primarily in software executed by a microprocessor-based controller, such as controller. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the refrigerator 10 or its subsystems. The computer-readable storage devices or media may include one or more of a number of known physical devices which utilize electric, magnetic, and/or optical storage to keep executable instructions and associated calibration information, operating variables, and the like.

The refrigerator 10, or more specifically the cabinet 18, includes panels or internal walls 22 that define the fresh food compartment 12 and the freezer compartment 14. The internal walls 22 may more specifically form an inner liner 23 of the refrigerator 10. The internal walls 22 may include a rear or back wall, a top wall, a bottom wall, and two opposing side walls within each of the fresh food compartment 12 and the freezer compartment 14. The dividing wall 16 may comprise one of the two opposing side walls in each of the fresh food compartment 12 and the freezer compartment 14. One or more shelves 24 may be secured to the interior walls 22 within the fresh food compartment 12 and/or the freezer compartment 14. One or more drawers 26 may be slidably secured to the shelves 24 or the internal walls 22 within the fresh food compartment 12 and/or the freezer compartment 14. The one or more drawers 26 may be crisper drawers that are slidably secured to the shelves 24 or the internal walls 22 within the fresh food compartment 12 and/or the freezer compartment 14. Crisper drawers may more specifically be drawers that define a storage space that is kept at a desired humidity that may be different from the remainder of the fresh food compartment 12, but that is optimal for maintaining freshness of fruits and vegetables.

The refrigerator 10, or more specifically the cabinet 18, includes an outer shell, outer frame, or outer housing 27 that comprises several exterior panels or walls 28. The outer shell, frame, or housing that comprises several exterior panels or walls 28 may also be referred to as the refrigerator cabinet wrapper. The exterior walls 28 may include a rear or back wall, a top wall, a bottom wall, and two side walls. An insulating material, such as an insulating foam, may be disposed between each exterior wall 28 and an adjacent corresponding interior wall 22 in order reduce the heat transfer from the ambient surroundings to the fresh food compartment 12 and the freezer compartment 14, which increases the efficiency of the refrigerator 10. The cabinet 18 (or more specifically the outer housing 27 or the exterior walls 28) may define an internal cavity. The inner liner 23 (or more specifically the interior walls 22) and the insulating material are disposed within the internal cavity defined by the outer housing 27 or the exterior walls 28. The inner liner 23 (or more specifically the interior walls 22) may in turn define the fresh food compartment 12 and the freezer compartment 14 within the internal cavity defined by the outer housing 27 or the exterior walls 28. Each exterior wall 28, adjacent corresponding interior wall 22, and the insulating material disposed between each exterior wall 28 and adjacent corresponding interior wall 22 may collectively be referred to as a single wall of the cabinet 18 of the refrigerator 10.

The refrigerator 10 may have one or more doors 30, 32 that provide selective access to the interior volume of the refrigerator 10 where consumables may be stored. As shown, the fresh food compartment door is designated 30, and the freezer door is designated 32. The doors 30, 32 may be rotatably secured to the frame or housing of the refrigerator 10 by one or more hinges. Alternatively, one or more of the doors 30, 32 may be configured to slide into and out of the cabinet 18.

The doors 30, 32 may each include an exterior panel 34 and an interior panel 36 that is disposed on an internal side of the respective exterior panel 34 of each door 30, 32. The interior panels 36 may be configured to face the fresh food compartment 12 and freezer compartment 14 when the doors 30, 32 are in closed positions. The interior panels 36 may more specifically be door liners. An insulating material, such as an insulating foam, may be disposed between the exterior panels 34 and an adjacent corresponding interior panel 36 of each door interior panel 36 in order reduce the heat transfer from the ambient surroundings and increase the efficiency of the refrigerator 10.

The interior panels 36 may also include shelves or storage bins 38 that are able to hold food items or containers. The storage bins 38 may be secured to the interior panels 36 of each door 30, 32. Alternatively, the storage bins 38 may be integrally formed within or defined by the interior panels 36 of each door 30, 32. In yet another alternative, a portion of the storage bins 38 may be secured to the interior panels 36 the doors 30, 32, while another portion of the storage bins 38 may be integrally formed within or defined by the interior panels 36 the doors 30, 32. The storage bins 38 may include shelves (e.g., a lower surface upon, which a food item or container may rest upon) that extend from back and/or side surfaces of the interior panels 36 of the doors 30, 32.

Figure 4:
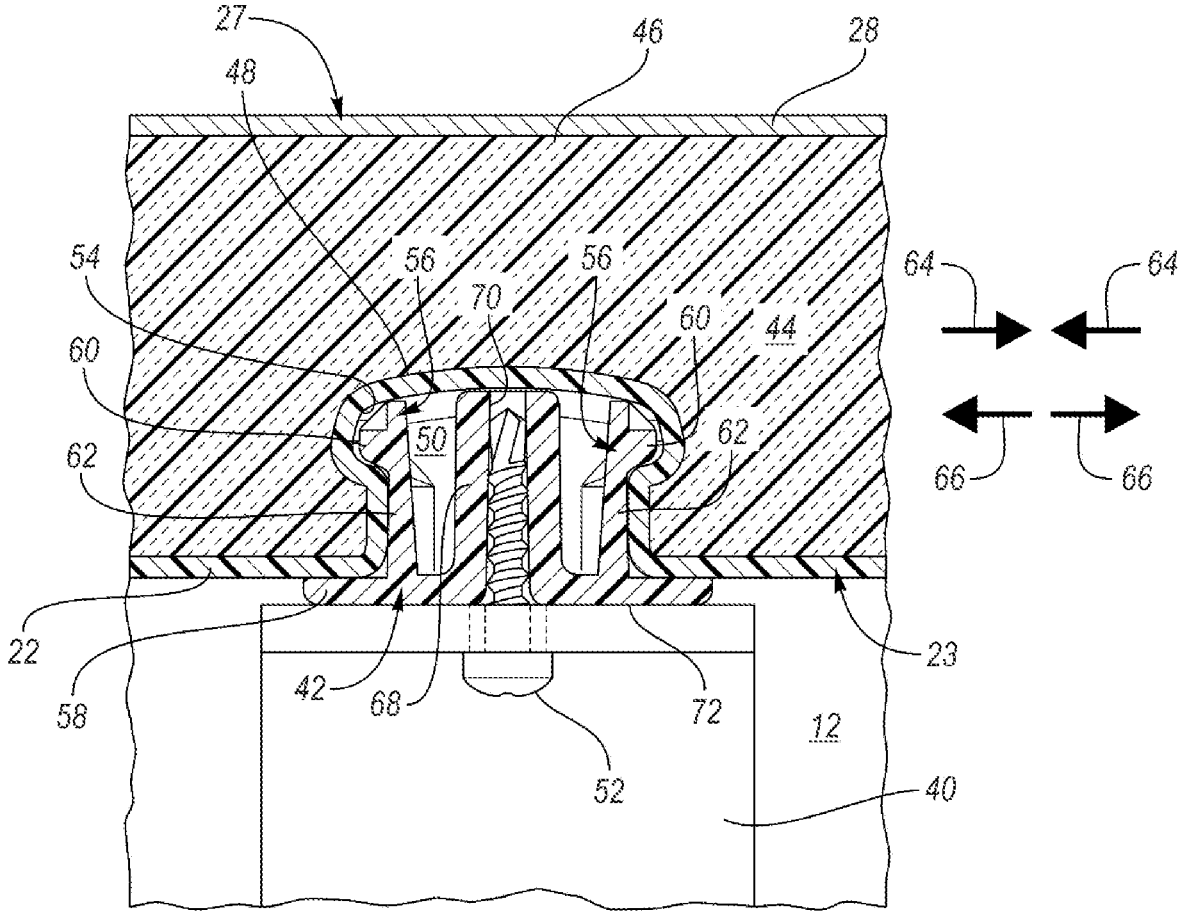
FIG. 4 is a cross-sectional view taken along line 4-4 in FIG. 2.
Figure 5:
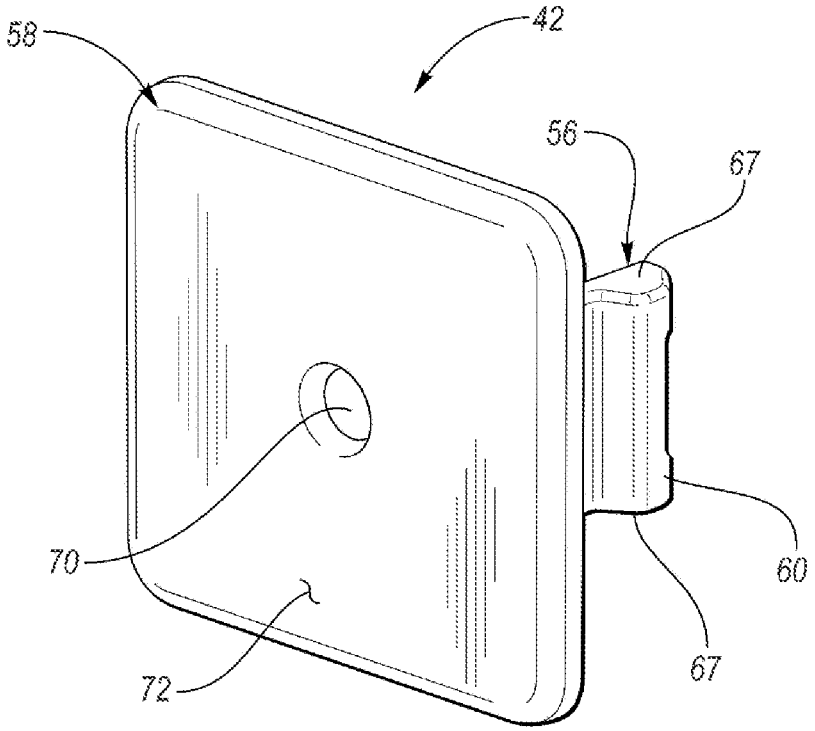
FIG. 5 is a front isometric view of the fastening anchor.
Figure 6:
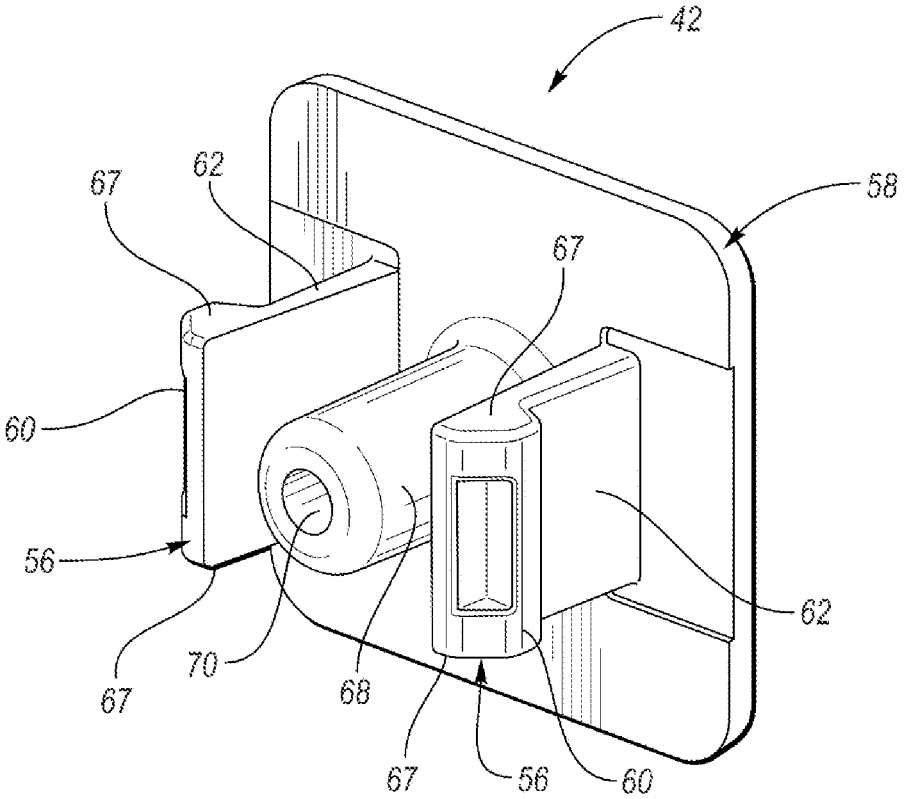
FIG. 6 is a rear isometric view of the fastening anchor.

Referring to FIGS. 2-6, a mounting system for the subcomponents 40 of refrigerator 10, which includes a fastening anchor 42, is illustrated. The fastening anchor 42 may be referred to as an anchor or an anchor block. The subcomponent 40 illustrated in FIG. 4 may be a portion (e.g., a mounting bracket, a mounting rail, support arm, etc.) of a shelf 24 or drawer 26 that is disposed within the fresh food compartment 12 or the freezer compartment 14. The mounting system may be utilized in appliances other than a refrigerator. FIG. 4 includes a cross-sectional view through one of the walls of the cabinet 18 of the refrigerator 10. The wall illustrated in FIG. 4 may be any of the walls of the cabinet 18 illustrated in FIG. 1. The wall may include one of the exterior walls 28 that is part of the outer housing 27 of the cabinet 18 and a corresponding interior wall 22 that is part of the inner liner 23 of the refrigerator 10. Alternatively, the wall illustrated in FIG. 4 may be an internal wall within the refrigerator 10 (e.g., the wall may be dividing wall 16 or some other internal wall that is within the fresh food compartment 12 or freezer compartment 14).

A gap 44 may be formed between the exterior walls 28 and the interior walls 22. An insulating material 46, such as an insulating foam, may be disposed in the gap 44 between each exterior wall 28 and adjacent corresponding interior wall 22 in order reduce the heat transfer from the ambient surroundings to the fresh food compartment 12 and the freezer compartment 14. The fresh food compartment 12 and the freezer compartment 14 may be defined by the inner liner 23 (or more specifically the interior walls 22) on an opposing side of the inner liner 23 relative to the gap 44. The subcomponent 40 is disposed within the fresh food compartment 12. Alternatively, the subcomponent 40 may be disposed within the freezer compartment 14, or other internal cavity defined at some position within cabinet 18.

The inner liner 23 (or more specifically one or more the interior walls 22) may have a protrusion 48 that extends into the gap 44. The insulating material 46 is disposed within the gap 44 and over the protrusion 48. The protrusion 48 may define a pocket 50 on an opposing side of the gap 44. The pocket 50 extends toward the outer housing 27, or more specifically toward one of the exterior walls 28. The pocket 50 also extends away or outward from the adjacent internal storage chamber (e.g., the fresh food compartment 12 or the freezer compartment 14). The pocket 50 is open or has an opening to the adjacent internal storage chamber (e.g., the fresh food compartment 12 or the freezer compartment 14). The pocket 50 is closed off from or is segregated from the gap 44. Stated in other terms, the pocket 50 may be a blind hole or orifice that does not extend through the inner liner 23 and is separated from the gap 44 via the inner liner 23. This ensures that the insulating material 46 does not flow into the adjacent internal storage chamber (e.g., the fresh food compartment 12 or the freezer compartment 14) when being installed or injected into the gap 44 during manufacturing.

The fastening anchor 42 is disposed within the pocket 50. The fastening anchor 42 engages the inner liner 23 (or more specifically engages one of the interior walls 22) within the pocket 50 such that the fastening anchor 42 is secured to the inner liner 23 (or more specifically is secured to one of the interior walls 22). The subcomponent 40 is disposed within the internal storage chamber (e.g., the fresh food compartment 12 or the freezer compartment 14) that is adjacent to the pocket 50. A fastener 52 engages the subcomponent 40 and the fastening anchor 42 to secure the subcomponent 40 to the inner liner 23 (or more specifically to one of the interior walls 22) and to the fastening anchor 42. More specifically, the fastener 52 may include threads that engage a tapped orifice or hole defined by the fastening anchor 42 or may be a self-tapping fastener that taps an orifice or hole defined the fastening anchor 42 to secure the fastener 52 to the fastening anchor 42.

A least a portion of the pocket 50 forms a T-slot 54. The fastening anchor 42 includes a pair of opposing snaps 56 that engage the T-slot 54 to secure the fastening anchor 42 to the inner liner 23 (or more specifically to one of the interior walls 22). The fastening anchor 42 also includes a base portion 58. The snaps 56 include head portions 60 and biasing portions 62. The biasing portions 62 secure the head portions 60 to the base portion 58 of the fastening anchor 42. The head portions 60 are configured to flex inward (e.g., see arrows 64 in FIG. 4) via the biasing portions 62 during installation of the fastening anchor 42 into the pocket 50. The head portions 60 are then configured to snap outward (e.g., see arrows 66 in FIG. 4) into the T-slot 54 upon completion of installation of the fastening anchor 42 into the pocket 50. The snaps 56 may be substantially parallel. Surfaces 65 within the pocket 50 that extend between the snaps 56 along opposing ends of the snaps 56 (e.g., the surfaces that are disposed above and below the snaps 56 in FIGS. 2 and 3) may be substantially flat. The substantially flat surfaces 65 may engage the opposing ends 67 of the snaps 56. The substantially parallel configuration of the snaps 56 and the engagement between the opposing ends 67 of the snaps 56 and the substantially flat surfaces 65 within the pocket 50 function to prevent rotation of the fastening anchor 42 within the slot 50, which is desirable particularly during engagement between the fastener 52 and the fastening anchor 42. Substantially parallel may refer to any incremental angle that is between exactly parallel and 20° from exactly parallel. Substantially flat surfaces may refer to surfaces that range from perfectly flat along a reference plane to surfaces having deviations of up to 3 millimeters from such a reference plane.

The fastening anchor 42 has a post 68 that is disposed between the snaps 56. The post 68 extends into the pocket 50 once the fastening anchor 42 is disposed within the pocket 50 and secured to the inner liner 23 (or more specifically to one of the interior walls 22). The post 68 defines the hole or orifice 70 that receives the fastener 52. More specifically, orifice 70 may be a tapped orifice that engages the threading of the fastener 52 or may be a through hole that is tapped by the fastener 52 upon engagement between the fastener 52 and the fastening anchor 42. The base portion 58 has a substantially flat exterior surface 72 that faces into the adjacent internal storage chamber (e.g., the fresh food compartment 12 or the freezer compartment 14) once the fastening anchor 42 is disposed within the pocket 50 and secured to the inner liner 23 (or more specifically to one of the interior walls 22). The orifice 70 may extend through the substantially flat exterior surface 72. The substantially flat exterior surface 72 provides a stable mating surface for the subcomponent 40.

The mounting system for the subcomponents 40 of refrigerator 10, which includes the fastening anchor 42, fastener 52, and pocket 50 illustrated in FIGS. 2-6 may be utilized to mount multiple components with the fresh food compartment 12 and the freezer compartment 14 of the refrigerator 10. For example, the inner liner 23 may define multiple pockets 50 in the fresh food compartment 12 and/or the freezer compartment 14, and a fastening anchor 42 and fastener 52 combination may be utilized in conjunction with each pocket 50 to mount subcomponents (e.g., shelves, drawer, etc.) to the inner liner 23 with the fresh food compartment 12 or freezer compartment 14.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

a cabinet having walls defining an internal cavity;

an inner liner (i) disposed within the internal cavity such that a gap is defined between the walls and the inner liner, (ii) defining a storage chamber on an opposing side of inner liner relative to the gap, and (iii) having a protrusion extending into the gap, wherein (i) the protrusion defines a pocket on an opposing side of the gap, (ii) the pocket is open to the storage chamber, (iii) the pocket is segregated from the gap, and (iv) the pocket comprises a blind hole such that the pocket is in fluid communication with the storage chamber and not in fluid communication with the gap, (v) at least a portion of the pocket is a T-slot, and (vi) the T-slot comprises a central region and first and second protruding regions extending outward from the central region in opposing directions;

an insulating material (i) disposed within the gap, (ii) between the walls and the inner liner, and (iii) over the protrusion;

a fastening anchor (i) disposed within the pocket, (ii) engaging the inner liner within the pocket such that the fastening anchor is secured to the inner liner, and (iii) includes a pair of opposing snaps that engage the T-slot within the first and second protruding regions to secure the fastening anchor to the inner liner;

a subcomponent disposed within the storage chamber; and a fastener engaging the subcomponent and the fastening anchor to secure the subcomponent to the inner liner and to the fastening anchor, wherein the fastener extends into the fastening anchor within the pocket and is sized such that an end of the fastener (i) terminates within pocket, (ii) does not extend through the inner liner, and (iii) does not extend into the gap, wherein the inner liner includes substantially flat surfaces that (i) partially define the pocket, (ii) are orthogonal to the first and second protruding regions of the T-slot, and (iii) engage opposing ends of each snap of the pair of opposing snaps to restrict rotation of the fastening anchor within the pocket.

2. The refrigerator appliance of claim 1, wherein (i) the fastening anchor includes a base portion, (ii) the snaps include head portions and biasing portions, and (iii) the biasing portions secure the head portions to the base portion.

3. The refrigerator appliance of claim 2, wherein the head portions are configured to (i) flex inward via the biasing portions during installation of the fastening anchor into the pocket and (ii) snap outward into the T-slot upon completion of installation of the fastening anchor into the pocket.

4. The refrigerator appliance of claim 1, wherein the fastening anchor has a post that is (i) disposed between the snaps of the pair of opposing snaps, (ii) extends into the pocket, and (iii) defines an orifice that receives the fastener.

5. A refrigerator appliance comprising:

cabinet walls defining an internal cavity;

a liner (i) disposed within the internal cavity; (ii) defining an internal storage chamber; and (iii) defining a pocket, wherein the pocket extends toward one of walls and is open to the internal storage chamber, (iv) the pocket comprises a blind hole such that the pocket is in fluid communication with the internal cavity and not in fluid communication with a space on an opposing side of the liner relative to the internal cavity, (v) at least a portion of the pocket is a T-slot, and (vi) the T-slot comprises a central region and first and second protruding regions extending outward from the central region in opposing directions;

an anchor (i) disposed within the pocket, (ii) engaging the liner such that the anchor is secured to the liner, (iii) including a pair of opposing snaps that engage the T-slot within the first and second protruding regions to secure the anchor to the liner, (iv) having a base portion, and (v) having a post that is (a) disposed between the snaps of the pair of opposing snaps, (b) extends into the pocket, and (c) defines an orifice, wherein the base portion has a substantially flat exterior surface that faces into the internal storage chamber, and wherein the orifice extends through the substantially flat exterior surface;

a subcomponent disposed within the internal storage chamber; and a fastener received within the orifice, engaging the subcomponent, and engaging the anchor to secure the subcomponent to the anchor, wherein the fastener extends into the anchor within the pocket and is sized such that an end of the fastener (i) terminates within pocket, (ii) does not extend through the liner, and (iii) does not extend into the space.

6. The refrigerator appliance of claim 5, wherein (i) the snaps include head portions and biasing portions and (ii) the biasing portions secure the head portions to the base portion, and wherein the head portions are configured to (i) flex inward via the biasing portions during installation of the anchor into the pocket and (ii) snap outward into the T-slot upon completion of installation of the anchor into the pocket.

7. The refrigerator appliance of claim 5, wherein the liner includes substantially flat surfaces, and wherein the substantially flat surfaces (i) partially define the pocket, (ii) are orthogonal to the first and second protruding regions of the T-slot, and (iii) engage opposing ends of each snap of the pair of opposing snaps to restrict rotation of the anchor within the pocket.

8. A refrigerator appliance comprising:

a cabinet having walls defining an internal storage chamber, wherein (i) a first of the walls defines a pocket that extends outward from and is open to the internal storage chamber and (ii) the pocket comprises a blind hole such that the pocket is in fluid communication with the internal storage chamber and not in fluid communication with a space on an opposing side of the first of the walls relative to the internal storage chamber;

an anchor (i) disposed within the pocket, (ii) engaging the first of the walls such that the anchor is secured to the first of the walls, (iii) having a post that extends into the pocket and defines an orifice, (iv) including a base portion that has a substantially flat exterior surface that faces into the internal storage chamber, wherein the orifice extends through the substantially flat exterior surface;

a subcomponent disposed within the internal storage chamber; and a fastener securing the subcomponent to the anchor, wherein the fastener extends into the anchor within the pocket, is received within the orifice, and is sized such that an end of the fastener (i) terminates within pocket and (ii) does not extend through the first of the walls.

9. The refrigerator appliance of claim 8, wherein the anchor includes at least one snap configured to engage the pocket to secure the anchor to the wall.

10. The refrigerator appliance of claim 9, wherein (i) the snap includes a head portion and a biasing portion and (ii) the biasing portion secures the head portion to the base portion, and wherein the head portion is configured to (i) flex inward via the biasing portion during installation of the anchor into the pocket and (ii) snap outward into the pocket upon completion of installation of the anchor into the pocket.

11. The refrigerator appliance of claim 9, wherein the first of walls includes substantially flat surfaces, and wherein the substantially flat surfaces (i) partially define the pocket and (ii) engage opposing ends of each snap of the at least one snap to restrict rotation of the anchor within the pocket.

* * * * *